US010052548B2

(12) United States Patent
Ratthe

(10) Patent No.: US 10,052,548 B2
(45) Date of Patent: Aug. 21, 2018

(54) ATTACHMENT MEANS FOR CONNECTING A GOALIE PAD TO A SKATE

(71) Applicant: Michel Ratthe, St-Fulgence (CA)

(72) Inventor: Michel Ratthe, St-Fulgence (CA)

( * ) Notice: Subject to any disclaimer, the term of this patent is extended or adjusted under 35 U.S.C. 154(b) by 168 days.

(21) Appl. No.: 15/235,139

(22) Filed: Aug. 12, 2016

(65) Prior Publication Data

US 2017/0209768 A1 Jul. 27, 2017

(30) Foreign Application Priority Data

Jan. 25, 2016 (GB) ..... 1601332.8

(51) Int. Cl.

| | |
|---|---|
| ***A63C 3/00*** | (2006.01) |
| ***A63B 71/12*** | (2006.01) |
| ***A44B 18/00*** | (2006.01) |
| ***A63C 1/42*** | (2006.01) |

(52) U.S. Cl.

CPC ..... *A63C 3/00* (2013.01); *A44B 18/00* (2013.01); *A63C 1/42* (2013.01); *A63B 2071/1258* (2013.01)

(58) Field of Classification Search

CPC ..... A63C 3/00; A63B 2011/1258; A63B 71/1225; A63B 2209/10; A63B 2071/1225

USPC ..... 2/22; 280/811

See application file for complete search history.

(56) References Cited

U.S. PATENT DOCUMENTS

| | | | | | |
|---|---|---|---|---|---|
| 3,769,722 | A * | 11/1973 | Rhee | A43B 5/00 | 36/2 R |
| 5,829,170 | A * | 11/1998 | Lutz, Jr. | A43B 5/1683 | 36/72 R |
| 6,678,894 | B2 * | 1/2004 | Norbutt | A63B 71/1225 | 2/22 |
| 8,959,801 | B1 * | 2/2015 | Siragusa, Jr. | A63B 71/1225 | 2/22 |
| 9,073,676 | B2 * | 7/2015 | Reidel | B23P 11/00 | |
| 9,498,691 | B2 * | 11/2016 | Antoine | A63B 69/0022 | |
| 9,616,315 | B2 * | 4/2017 | Smith | A63B 71/1225 | |
| 2008/0148531 | A1 * | 6/2008 | Buckley | A63B 71/1225 | 24/265 H |
| 2009/0224525 | A1 * | 9/2009 | Goor | A63B 71/1225 | 280/811 |

* cited by examiner

*Primary Examiner* — Ruth Ilan

(57) ABSTRACT

An attachment means for connecting a goalie pad to a skate. Has a string which has elastic characteristics and which is retained substantially at its mid-point by a pad attachment member and which has its two distal ends capped with a hook means and a loop means. The string is wrapped first under and then over the skate (or vice versa) so that the hook and loop means can mate and thus securely retain the lower part of the pad onto the skate.

4 Claims, 3 Drawing Sheets

ATTACHMENT MEANS FOR CONNECTING A GOALIE PAD TO A SKATE

FIELD OF THE INVENTION

The present invention relates generally to attachment means but more particularly to an attachment means for connecting a goalie pad to a skate.

BACKGROUND OF THE INVENTION

In order to properly perform the task of tending a goal in hockey, the large and bulky pads must be properly attached to the area below the knees. This can be easily done by way of adjustable straps. The problem is at the foot level where the skate makes it a little harder to provide good attachment. After all, the foot extends perpendicularly from the leg and a nook is made into the base of the pad so as to allow the skate tip to protrude. Traditionally, long laces are used and wrapped around the skate so as to stabilize the pad over the skate. The problem is that those laces get loose over time and the pad is no longer very stable and no longer located at its optimal position. There is a need for a better solution which would provide for a tight attachment means that can maintain the pad in an optimal placement.

SUMMARY OF THE INVENTION

In view of the foregoing disadvantages inherent in the known devices now present in the prior art, the present invention, which will be described subsequently in greater detail, is to provide objects and advantages which are:

To provide for an attachment means for connecting a goalie pad to a skate that can maintain the pad in an optimal placement.

In order to do so, the invention comprises a string which has elastic characteristics and which is retained substantially at its mid-point by a pad attachment member and which has its two distal ends capped with a hook means and a loop means. The string is wrapped first under and then over the skate (or vice versa) so that the hook and loop means can mate and thus securely retain the lower part of the pad onto the skate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION

Figure 1:
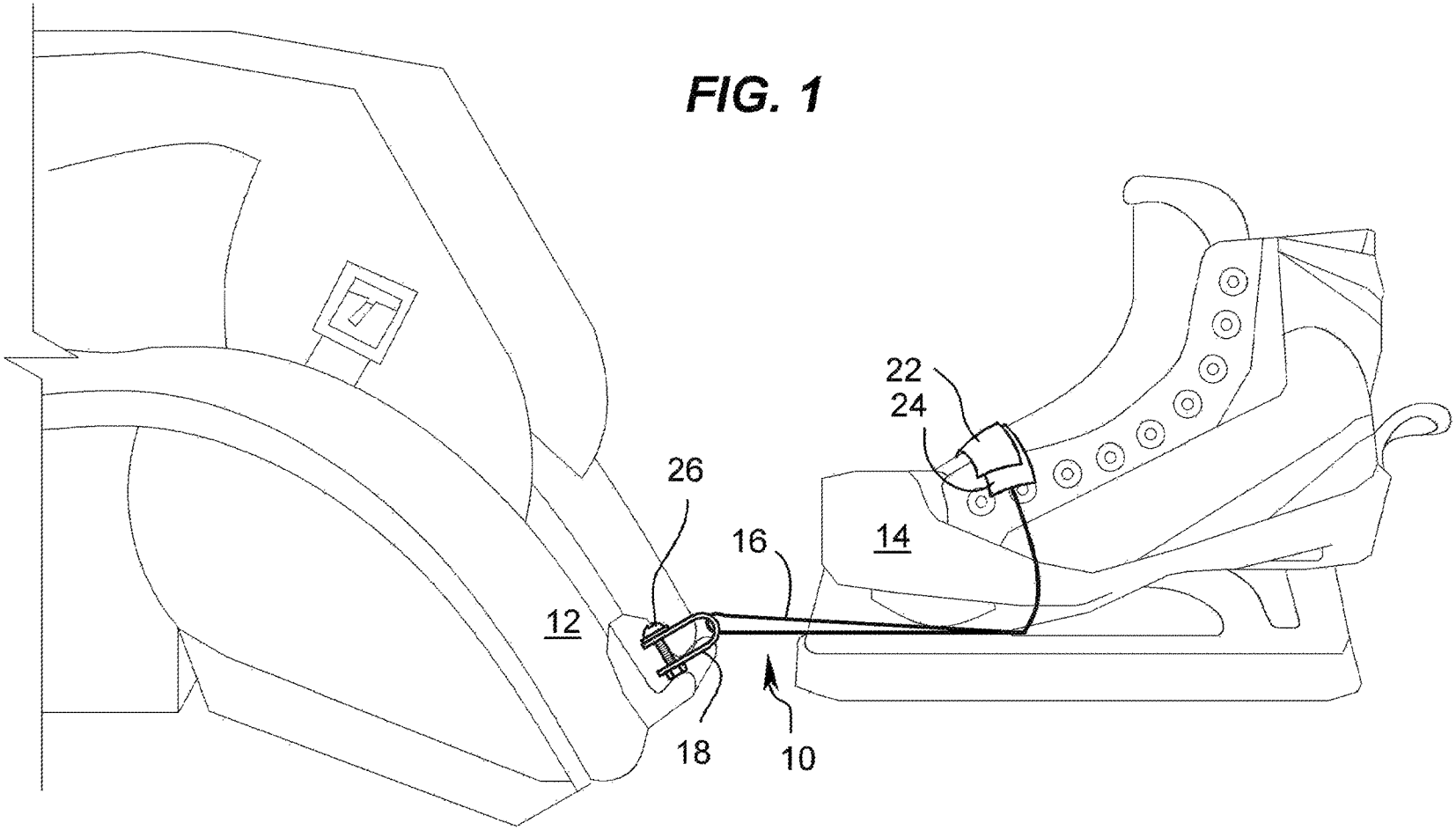
FIG. 1 Isometric view of the invention in context.
Figure 2A:
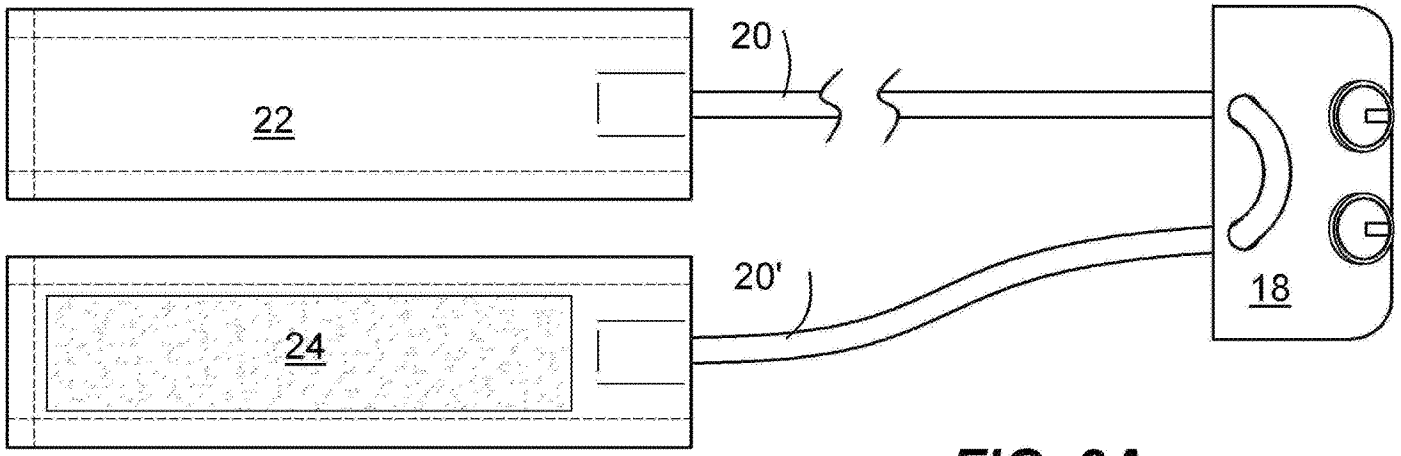
FIGS. 2*a-b* Top and side views of the invention.
Figure 2B:
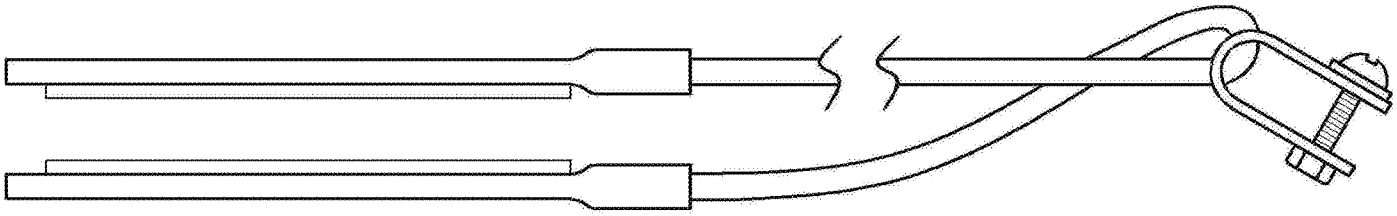
Figure 3:
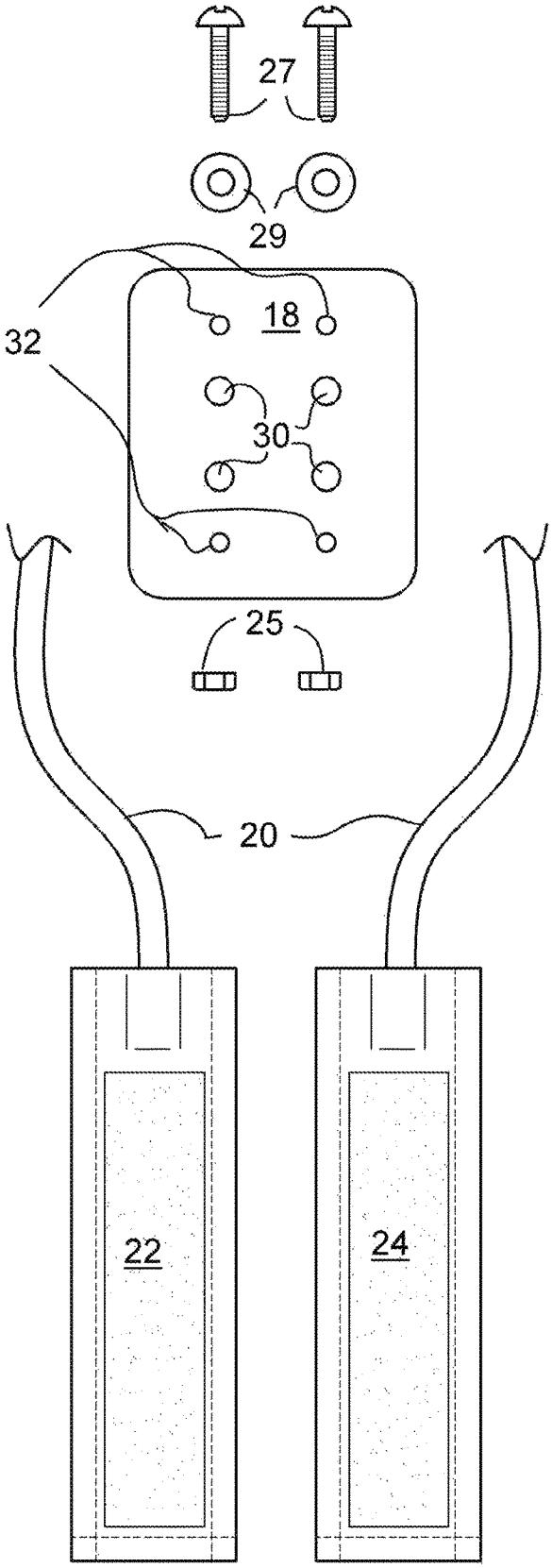
FIG. 3 Top view of the invention dismantled.

An attachment means (10) for connecting a goalie pad (12) to a skate (14) is comprised of a string (16) which has elastic characteristics and which is retained at its mid-point by a pad attachment member (18) and which has its two distal ends (20, 20') capped with a hook means (22), and a loop means (24). The string (16) is wrapped under and over the skate (14) so that the hook and loop means (22, 24) can mate and thus securely retain the lower part of the pad (12) onto the skate (14).

The pad attachment member (18) consists in a looped flexible material, such as leather, for example, and which uses mechanical fasteners (26)—generally nuts (25), bolts (27), washers (29)—to be affixed to the pad (12). By being folded onto itself, it can clamp into a portion of the pad (12) with the mechanical fasteners (26) passing through openings (32) in the attachment member (18) and through the pad (12) itself so as to be solidly secured. Also, by passing through four holes (30), the string (16) is more secured.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A combination of a hockey goalie pad, a skate and an attachment means wherein a bottom portion of a goalie pad is attached to a skate by way of a string, and wherein said string is connected to said goalie pad by way of said attachment means; said string having its two distal ends capped with a hook means, and a loop means; said string being wrapped under and over said skate so that said hook and said loop means can mate and thus securely retain said bottom portion of said goalie pad onto said skate; said attachment means including a pad attachment member consisting in a looped flexible material using mechanical fasteners so as to be affixed to said pad by being folded onto itself so as to create a closed loop and thus clamp onto a portion of said pad and with said mechanical fasteners passing through openings made through said attachment member and through said pad itself so as to be solidly secured while allowing for the passage of said string.

2. A method of attaching a hockey goalie pad to a skate using said attachment means of claim 1 consisting in the steps of connecting said bottom portion of said goalie pad to said skate, using said string wherein said string being retained substantially at its mid-point by said pad attachment member; said string having two distal ends capped with said hook means, and said loop means so that after wrapping said string; said string over and under said skate, its ends are mated so as to securely retain said bottom portion of said goalie pad onto said skate.

3. The combination of claim 1 wherein said string has elastic characteristics.

4. The Method of claim 2 wherein said string has elastic characteristics.

* * * * *